US005957776A

United States Patent [19]

Hoehne

[11] Patent Number: 5,957,776

[45] Date of Patent: Sep. 28, 1999

[54] TABLE GAME CONTROL SYSTEM

[75] Inventor: Chad Hoehne, Minnetonka, Minn.

[73] Assignee: Table Trac, Inc., Minnetonka, Minn.

[21] Appl. No.: 08/689,351

[22] Filed: Aug. 8, 1996

Related U.S. Application Data

[60] Provisional application No. 60/002,071, Aug. 9, 1995.

[51] Int. Cl.[6] ..... A63F 9/24

[52] U.S. Cl. ..... 463/25; 273/148 R; 364/412.1

[58] Field of Search ..... 463/25, 16, 1, 463/12, 13; 364/412, 410; 273/309, 292, 274, 148 R

[56] References Cited

U.S. PATENT DOCUMENTS

| | | | |
|---|---|---|---|
| 4,531,187 | 7/1985 | Uhland | 364/412 |
| 4,755,941 | 7/1988 | Bacchi | 364/412 |
| 4,818,974 | 4/1989 | Fernandez . | |
| 5,429,361 | 7/1995 | Raven et al. | 463/25 |
| 5,613,912 | 3/1997 | Slater . | |
| 5,651,548 | 7/1997 | French et al. | 273/309 |
| 5,770,533 | 6/1998 | Franchi | 463/42 |

OTHER PUBLICATIONS

AutoTote's AutoTrak II system Overview 1992.
PitTrak Player Tracking System, Feb. 24, 1995.
Reno Gazette Journal Article Jan. 18, 1995.
"Introducing the Next Logical Step in Player Tracking", *Central States Gaming*, vol. 1, No. 12, Apr. 17, 1995.
"Probe XL", *Autotote*, 1993.

*Primary Examiner*—Michael O'Neill
*Attorney, Agent, or Firm*—Westman, Champlin & Kelly

[57] ABSTRACT

A system tracks information indicative of operations of one or more gaming tables, a dealer, a floor manager or a player. An electronic input device is placed at each table and receives the information.

22 Claims, 6 Drawing Sheets

TO HOST CONTROL UNIT 30
20
40
42
44
46
48
50
52
54
56
58
59
60
62
64
66

TABLE GAME CONTROL SYSTEM

REFERENCE TO RELATED APPLICATION

The present application is based on a provisional application Ser. No. 60/002,071 filed on Aug. 9, 1995.

BACKGROUND OF THE INVENTION

The present invention deals with a table game management system. More particularly, the present invention deals with a system for receiving and correlating data indicative of the operations of a gaming table.

A conventional casino has a number of gaming tables distributed therethrough. The tables are typically arranged in groups, each group being managed from a management area referred to as a pit. The manager of the pit is referred to as a pit boss or pit manager. The pit manager supervises a number of floor managers, each of whom is in charge of supervising a number of tables in the pit.

Each casino gaming table generally includes a table top where a dealer deals cards, and where patrons place bets and play the card games associated with the table. The table top also typically includes a chip tray which is located in front of the dealer and holds chips of various denominations. Gaming tables also include a lock box which is securely fastened to the underside of the table and which is locked in place with a key. The lock box has an opening at its upper end which is aligned with an opening in the table top. A lock box paddle extends down through the opening in the table top into the lock box. When a patron wishes to obtain a desired number of chips to begin playing the game, or to continue playing the game, the patron hands bills of various denominations to the dealer. The bills are taken by the dealer and pushed into the lock box, through the slot in the table top, using the paddle. In return, the dealer provides the player with a number of chips equal to the denomination value of the money which the dealer places in the lock box.

In order to determine whether the table has made or lost money for the casino, a manager must determine the amount of money which has been dropped, as well as the change in chip inventory in the chip tray. The difference between the chip inventory at the beginning and the end of a shift, as well as the inventory in the lock box at the beginning and end of the shift, determines whether the table has made or lost money during that shift.

Also, it is widely held that the amount of money which is dropped is quite directly related to the abilities of the dealer. In other words, if the dealer is friendly and talented, he or she is more likely to attract more players, and hence more money, to the table than would otherwise be the case.

Numerous security issues surround the casino atmosphere. A security station is manned by security personnel and is typically remote from the pit area and from the gaming tables. Therefore, when a pit manager determines that a security person is desired (e.g., when it is time to replenish chip inventory at one of the gaming tables in the pit area) the pit manager must send a message to the security station, and also to a vault and cashier area to prepare the "fill". A member of the casino security escorts a chip carrier containing chips to fill the chip tray. This is a cumbersome and time consuming process. Of course, the longer that any given table is unable to play because it is waiting for a chip fill, the more money is lost by the casino.

Other security issues are also present. For example, if a dealer suspects that one or more members at his or her table are cheating (e.g., capping bets or team playing), there is currently no way for the dealer to alert the security station to keep an eye on such suspected players, other than by disrupting the game and physically sending a message to the security station. Further, if the security station observes (such as through security cameras) that a player is suspected of cheating, there is currently no way for the security team to send a message to the dealer, other than by physically contacting the dealer.

In addition, current report generation systems are very cumbersome and time consuming. For instance, it typically takes 12 to 36 hours to generate reports as to how successful any given table has been. This is because, at the end of each playing session, each table must be closed out by providing an ending chip inventory and an ending lock box inventory. The lock box inventory is counted by a count room which is remote from the pit areas. The people in the count room also take into account the beginning and ending chip inventories in the chip tray, the number of fills made to the chip tray, and the amount of cash previously removed from the table by replacing the lock box. After tabulating all of these numbers, the count room personnel can determine whether each table has made or lost money and the amount of money which has been made or lost. The count room can also correlate that information with the remaining tables in that pit area, and generate reports, on a casino wide basis, on a pit wide basis or on a table-by-table basis, which can then be used by managers in making management decisions. However, this is an extremely time consuming and labor intensive process because of its current manual nature.

Further, since dealers at each table are rotated often during each day of gaming activity, it is very difficult to obtain a beginning and ending chip inventory for each dealer's shift on a given table. In fact, this is currently not being done because it would require the pit manager to attempt to observe the inventory in the chip tray as a new dealer approaches the table. This would require visually observing the chip tray and estimating the denomination value of all chips in the tray. This is so difficult and inaccurate using prior systems that it is simply not done.

Also, in order to gauge the performance of a dealer or table, one must determine the amount of cash dropped either during the particular dealer's shift or during a shift for the table. This is currently being done by each dealer calling out the denomination to be dropped into the lock box just prior to dropping that denomination and waiting for a verbal acknowledgement from the floor manager. The floor manager then typically marks this amount down on a pad of paper and, at the end of each shift, does a very quick and very rough estimate of the amount of cash dropped. The floor manager must do this in addition to observing the beginning and ending chip inventories in the chip tray for each dealer or for each shift. Of course, this system is very inaccurate and time consuming, and it is not even done for each dealer, but only for each table.

Additionally, the lock boxes are periodically removed from the tables and replaced with empty lock boxes. The full lock boxes are taken to a remote count room where the money contained therein is counted to obtain a "soft count." Other than the rough estimates made in the pit, there is currently no way to verify the soft count. This, of course, poses security concerns.

The prior system also makes it very difficult to determine whether a dealer is cheating. For example, most games played at a gaming table are structured with odds such that the casino will, over a period of time, collect a percentage of the amount bet at the table. If the dealer is cheating, this percentage will be lower, or could be zero or negative. However, any dealer can have any given shift, or number of shifts, where this percentage is lower than expected, or negative. Therefore, in order to determine whether a dealer is cheating, one must have a very accurate tally as to whether the table makes or loses money during that dealer's shifts, over a long period of time. Given the inaccuracies in the present estimations as to whether the table makes or loses money during a dealer's shift, this is currently very difficult to determine and is not typically done on a dealer-by-dealer basis.

It is also desirable to track the performance of certain players who play on a non-cash basis. For example, certain players are provided with a credit amount from the casino and can play at the gaming tables using markers. However, the credit amount can be raised, lowered, or completely discontinued, by the casino at any time for any given player. It is currently a difficult and time consuming process for a floor manager to determine whether a player has credit with the casino, and the amount of that credit. Also, since reports can only be generated after a delay of 12 to 36 hours, the casino may not have enough up to date information to determine whether a player's credit should be discontinued. This allows the player to use substantial additional credit from the casino when the casino would not otherwise extend such credit. Therefore, the inability to track the performance of ceratin players on a real time basis is problematic.

Another reason why player tracking is desirable is for rating players. If a player bets a sufficient amount at a casino (regardless of win/loss), casinos often wish to provide certain complimentary items to that player. This is because the odds favor the casino so that if a player bets enough money over a long period of time, that player is likely to be a good customer of the casino. In turn, the casino may wish, for marketing purposes, to return some percent of the bets to the player in the form of complimentary points or dollars which can be spent at the casino. It is currently very difficult for a casino to track players' activity (such as buy-ins, average bets, and time spent playing) sufficiently to establish such ratings. Tracking this activity is currently very time consuming.

SUMMARY OF THE INVENTION

A system tracks information indicative of operations of a gaming table, a dealer, a floor manager or a player in a pit. An electronic input device is placed at each table and receives the information.

In one embodiment, a denomination input device is located at the table and provides denomination signals, based on operator inputs, indicative of denominations placed in the lock box. A display is coupled to the denomination input device and displays denomination indicia based on the denomination signals. A host control system is coupled to the denomination input device. The host control system receives the denomination data and provides substantial real time reporting capability.

In other embodiments of the present invention, the present system tracks chip inventory, security information and dealer and player information.

DETAILED DESCRIPTION OF THE PREFERRED EMBODIMENTS

Overview

1. Block Diagram

Figure 1:
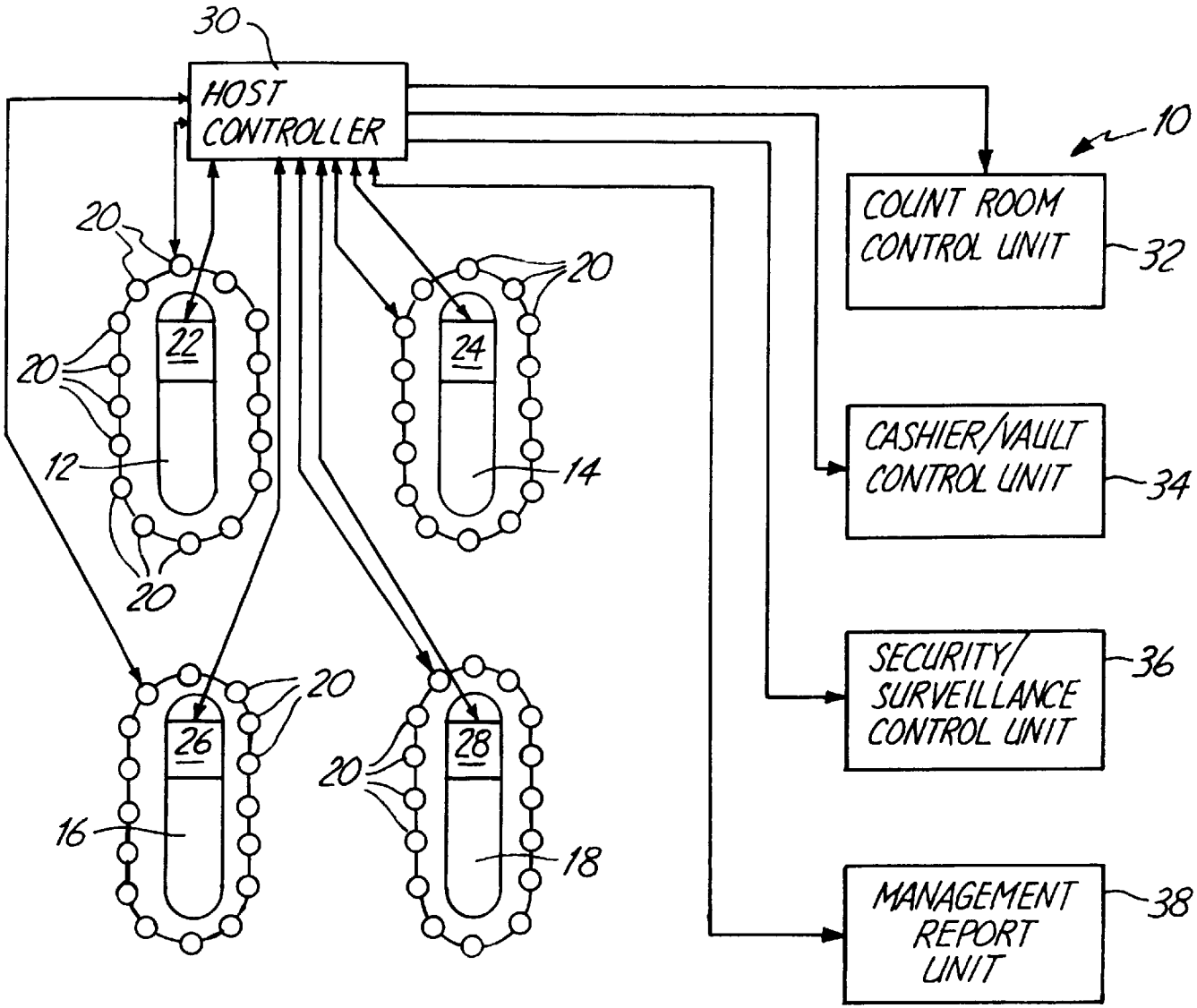
FIG. 1 is a block diagram of a table tracking system according to the present invention.

FIG. 1 is a block diagram of a table tracking system 10 according to the present invention. System 10 includes a plurality of pit areas 12, 14, 16 and 18. Each pit area is preferably surrounded by a plurality of gaming tables 20. Gaming tables 20 are all preferably provided with a table control unit (shown in greater detail with respect to FIGS. 2A–4). The table control unit on each table is connected to the other table control units by a suitable link. The table control units are also coupled to a host controller 30. In one preferred embodiment, the table control units are coupled to one another using an RS485 communications protocol addressing multiple devices on a single line.

Pit control units 22, 24, 26 and 28 are located in the pit areas 12, 14, 16 and 18, respectively, and are coupled to host controller 30 which, in the embodiment shown in FIG. 1, is shown located remotely from pit areas 12, 14, 16 and 18. Of course, host controller 30 could also be implemented in one of pit control units 22, 24, 26 and 28. Host controller 30 is, in turn, coupled to count room control unit 32, cashier and vault control unit 34, security and surveillance control unit 36 and management report unit 38.

In the preferred embodiment, pit control units 22, 24, 26 and 28, as well as host controller 30, count room control unit 32, cashier and vault control unit 34, security and surveillance control unit 36 and management report unit 38 are all digital controllers or digital computers each having an operator interface. In a more preferred embodiment, host controller 30 is a Pentium based host computer. Also, in the preferred embodiment, the operator interfaces include a display and an operator input device. The display is preferably a CRT-type monitor or other suitable display, and the operator input device is preferably a keyboard, membrane keypad, touch screen, or other suitable operator input device. All of the electronic units are preferably coupled to one another using a suitable interface, such as an RS485 Communications Interface, or an RS232 Communications Interface.

In operation, each of the table control units associated with tables 20 receive information indicative of the operations of the table. Such information is described in greater detail later in the description and includes, for example, the amount of money dropped at the table, the chip inventory, security information, and dealer, player, pit manager, floor manager and security guard identification information. Host controller 30 intermittently polls the table control units to initiate a transfer of the information received at the table control units to the host control unit. The host control unit then tabulates and correlate the information received in a desired fashion.

Host controller 30 includes a data base which maintains the information provided by the table and pit control units, and other control units, and arranges that information in a desired manner so that it is accessible by the other control units in system 10.

2. Chip Inventory Data

Periodically, upper management wishes to determine the win/loss for the casino, or for a particular pit area, during a shift. In such instances, the table control units on each table 20 are called upon to provide updated information as to how much cash has been dropped into the drop boxes during that shift. Also, the chip inventory detector (described in greater detail later in the specification with respect to FIGS. 5 and 6) is called upon to provide a then current chip inventory. Host controller 30 then determines the total win/loss for each table, for each pit, or on a casino wide basis. Therefore, a very accurate win/loss figure can be obtained using the present invention, during a shift, in a very quick and efficient manner.

Also, the pit managers in pit areas 12, 14, 16 and 18 determine a chip inventory which needs to be maintained in each of the chip trays associated with tables 20. When it is determined that the inventory in the chip trays falls below this threshold level, a request is sent from the table control unit for the table holding that chip tray, to the host controller 30, and to cashier and vault control unit 34. The cashier and vault control unit 34 then displays a message, or preferably prints a request, that additional chips be provided to the necessary table. In one preferred embodiment, host controller 30 also simultaneously sends a message to security and surveillance control unit 36 indicating that a security guard is requested to either accompany another casino employee carrying the chips, or to carry the chips, to the table which has requested a chip fill. In the preferred embodiment, this is all done automatically and the chips reach the table much more quickly and efficiently than under manual type systems in which the floor manager would indicate to the pit manager that a chip fill was needed. The pit manager would then send a message to the security and surveillance area using a human runner, or the like. The security person would then need to proceed to the cashier and vault area and request additional chips. The chips would then be physically carried back to the pit manager who would then fill the table. This is very time consuming and, if the table cannot proceed with play until the chip fill has occurred, this can cost the casino a great deal of money. Therefore, the present invention provides automatic chip fill requests which greatly enhance the efficiency of the system.

3. Security Communications

System 10 also facilitates two-way communication between the security and surveillance area and the dealers of each of the individual tables 20. For example, if the dealer believes that the security and surveillance personnel should pay particularly close attention to a player which is suspected of cheating, the dealer at the table 20 can actuate an operator input which sends a message to host controller 30. Host controller 30, in turn, sends a surveillance request message to security and surveillance control unit 36. The security personnel observing the security and surveillance control unit 36 can then operate surveillance cameras, or take other appropriate action, to bring the suspected player under closer observation.

Similarly, if, using surveillance equipment, the security personnel wish to alert the dealer to the fact that one of the players may be cheating, the security personnel can actuate an operator input (such as a keyboard input) on security and surveillance control unit 36 which causes a message to be sent to host control unit 30. The message contains the address of the particular table 20 to which the message is to be sent. Host controller 30 then sends a message to the desired table control unit which displays a message for the dealer indicating that a certain player position on the table 20 is to be closely observed.

Thus, system 10 is suitable for providing two-way communication between the security personnel of the casino and the dealers in the casino and pit managers, without raising the attention of any of the players in the casino.

4. Report Generation

Host controller 30 is configured to receive and retain and store all desired information from other portions of system 10, and to correlate that information in a desired manner. Therefore, using the management report unit 38, management personnel can access the information in host controller 30 and print or display desired reports which show the profitability of each table, the profitability associated with each dealer, and the profitability associated with each pit area or pit manager. The system 10 can also accurately ensure that the money received in the lock boxes at tables 20 reaches count room 32. System 10 is also suitable for generating and completing the necessary detailed paperwork and accounting for the vault and cashier areas and for the count room. System 10 is also capable of providing directions which allow much more smooth flow of the casino operations while play is commenced.

More Detailed Operation

1. The Table

Figures 2A, 2B:
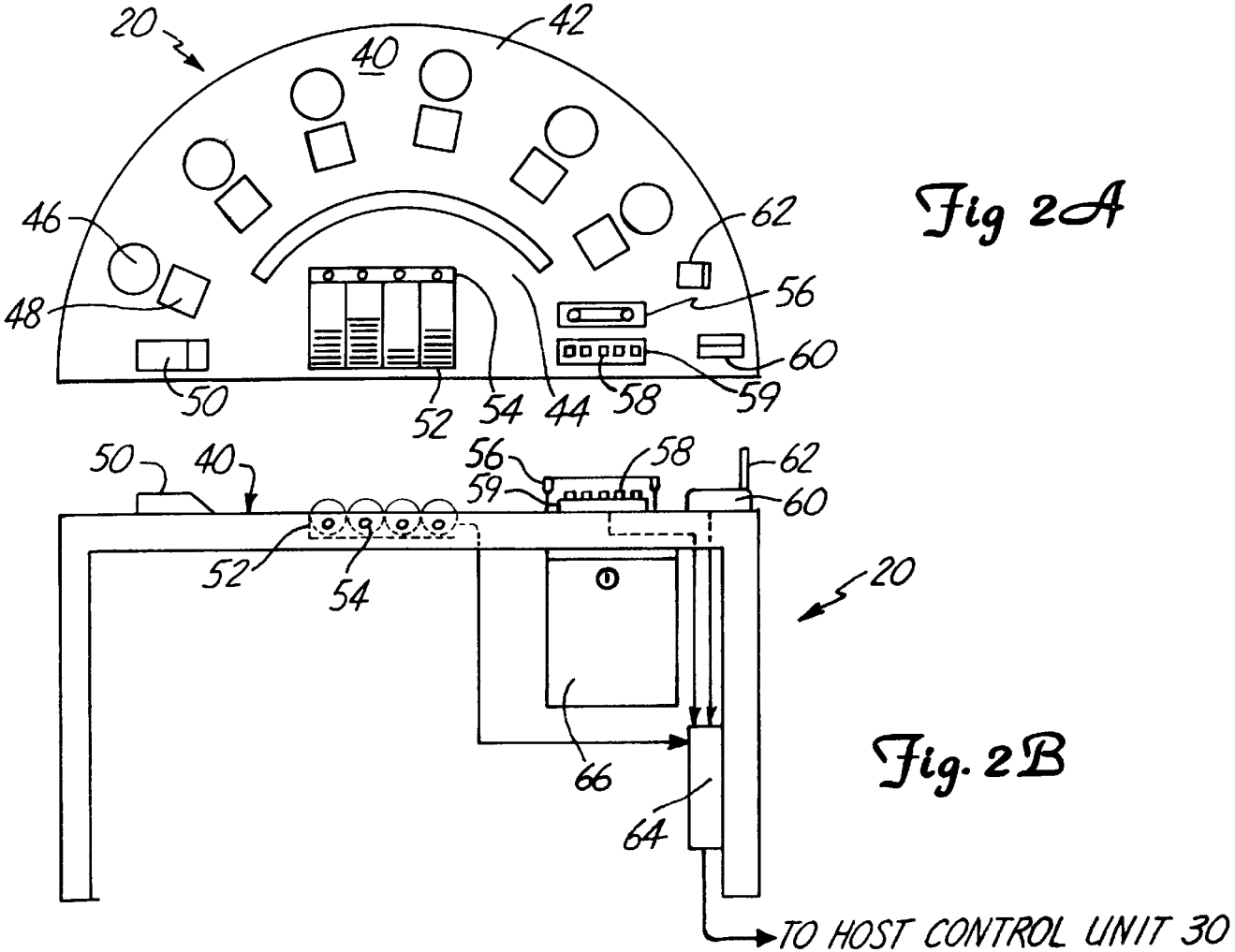
FIG. 2A is a top view of a gaming table implementing the tracking system according to the present invention.
FIG. 2B is a side view of the gaming table shown in FIG. 2A.

FIG. 2A is a top view illustrating a table top 40 of a gaming table 20 according to the present invention. FIG. 2B is a side view of the table 20 shown in FIG. 2. Table top 40 is typically divided into a player area 42 and a dealer area 44. Player area 42 typically includes indicia, such as circles 46, where bets are typically placed prior to a game. Player area 42 also includes indicia, such as rectangular areas 48, where the dealer displays the cards dealt to the player residing at that position. Dealer area 44 includes card shoe 50, chip tray 52, chip tray inventory detector 54, bill drop slot 56, operator input device 58, magnetic card reader 60 and used card holder 62.

2. A Dealer's Shift a. Normal play

When a dealer approaches table 20, the dealer runs a magnetic card containing identification information indicative of the dealer's identity through magnetic card reader 60. Magnetic card reader 60, in turn, generates signals indicative of the information stored on the magnetic card and provides them to table control unit 64. At that time, table control unit 64 initiates an inventory detection using chip inventory detector 54 and detects and records the chip inventory in chip tray 52. This gives a chip inventory at the beginning of the dealer's shift and a chip inventory at the end of the previous dealer's shift.

If the dealer determines that someone at the table would like additional chips, the dealer takes money from the player and provides a number of chips to the player having a total denomination value equal to the denomination value of the money received from the player. The dealer then places the money over drop slot 56 and drops the money into lock box 66. Either immediately after dropping the money, or just prior to dropping the money, the dealer enters the denomination value of the money to be dropped through various denomination value keys on keypad 58. Optionally, the table control unit 64 can be configured to prompt for the table position of the player requesting the additional chips (making a buy-in). This is simply entered by the dealer on keypad 58. This information is sent, via a suitable communication, to the table control unit 64. Table control unit 64 receives and stores this information. In another preferred embodiment, table control unit 64 is physically housed in the same housing that supports keypad 58.

In dealing, the dealer removes cards from shoe 50 and places them in card display areas 48 for the various players at table 20. After each hand, the dealer removes chips from betting areas 46 of the players who lost the hand (decision), and pays chips from chip tray 52 to the players who won the hand (decision). The dealer then places the used cards in used card holder 62.

Therefore, during a dealer's shift, the dealer adds chips to and removes chips from the chip inventory in chip tray 52, makes additional cash drops into cash drop slot 56 and enters the denomination values through keypad 58 equal to the value of the cash dropped. All of this information is stored in table control unit 64 for future access.

b. chip fill

Prior to the dealer's shift, table control unit 64 is programmed with a low chip inventory threshold value. If, during the dealer's shift, the chip inventory in chip tray 52, as detected by chip inventory detector 54, falls below the low chip inventory threshold, then table control unit 64 sends a chip fill request to host controller 30. The chip fill request is displayed at the pit control unit corresponding to the table control unit 64 which made the request. The pit manager can then intervene to change the amount of chips requested based on experience and factors such as the time of day and the level of the crowd in the casino.

Once the request is finalized, as described with respect to FIG. 1, this request is relayed through host controller 30 to cashier and vault unit 34 where the request is received. The chip fill request is then serviced by casino personnel.

In servicing the request, a chip carrier (such as a security guard or another casino employee) obtains chips from the chip vault area. Prior to leaving the cashier and vault area, in one preferred embodiment of the present invention, the chip carrier enters at cashier and vault control unit 34 the amount of chips leaving the cashier and vault area. This is correlated with the chip fill request at host controller 30. If the amount leaving the cashier and vault area is not the same as the amount requested, then the chip carrier is unable to enter that information at the cashier and vault control unit 34, and the chip carrier is alerted to the error. However, if the value of the chips leaving the cashier and vault area is correct, the information will be entered and stored in host controller 30.

The chip carrier then brings the denomination value of chips to the table 20 which requested the chip fill. The pit manager allows the chip carrier to enter the pit area and fill the chip tray. This information is entered at the pit control unit by the pit manager. The pit manager is preferably required to enter the serial number of the request. If this serial number does not correspond to the specific table 20 which made the chip fill request, then the pit manager is notified by the pit control unit indicating that the casino personnel are attempting to fill the wrong table. The pit manager can then correct this error.

Assuming that the casino personnel are attempting to fill the correct table, the chip carrier slides a magnetic card (containing identification information indicative of the identity of the chip carrier) through magnetic card reader 60. This is entered in table control unit 64. The chip carrier then fills chip tray 52 and chip inventory detector 54 again detects chip inventory in chip tray 52. This information is entered in table control unit 64.

Once chip inventory detector 54 has detected the inventory in chip tray 52 after the fill, host controller 30 is capable of verifying that all of the chips which left the cashier and vault area were actually received by the appropriate table which requested the fill. Of course, the identity of the chip carrier or security guard is also recorded and correlated with the chip fill transaction.

Table control unit 64 may also be preprogrammed with a high chip inventory threshold. If the chip inventory in chip tray 52 exceeds the threshold, a removal request is sent to the cashier and vault area. The chip removal process essentially operates in reverse order of a chip fill transaction and similar information is recorded in the system.

c. lock box removal

Periodically, a full lock box 66 is removed and replaced at table 20 by an empty lock box 66. This is typically done, for instance, at midnight, 8:00 a.m. and 4:00 p.m. or whenever a shift rolls over. At this same time, possession of the pit is transferred from an outgoing pit manager to an incoming pit manager. Since cash in the lock box 66 is a determining factor in shift win/loss, the chip inventory must also be counted when a shift rolls over. This establishes a closing inventory for the previous shift and an opening inventory for the new shift.

When the lock box 66 is to be changed, count room personnel provide a security guard with an empty lock box. The security guard proceeds to the pit area. The pit manager allows the security guard to access the pit area and change the lock boxes 66 for each table 20 corresponding to that pit area, in sequence. Before accessing each lock box 66 at each table 20, the security guard passes his magnetic card through magnetic card reader 60 so that the identity of the security guard removing the lock box 66 full of cash is recorded in the system. The system then detects and records the chip inventory for that table 20 and displays the inventory value at the table control unit for verification. Both the outgoing pit manager and the incoming pit manager view this amount and pass their identification cards through card reader 60 as verification.

The fact that the full lock boxes 66 have been removed, the amount of money contained in each of the full lock boxes 66, the chip inventory, along with the identity of the security guard who removed the lock boxes and the outgoing and incoming pit managers, are then stored in table control unit 64. This information is periodically uploaded to the host control unit 30 associated with table control unit 64.

d. detailed operation of keypad 58

Figure 2C:
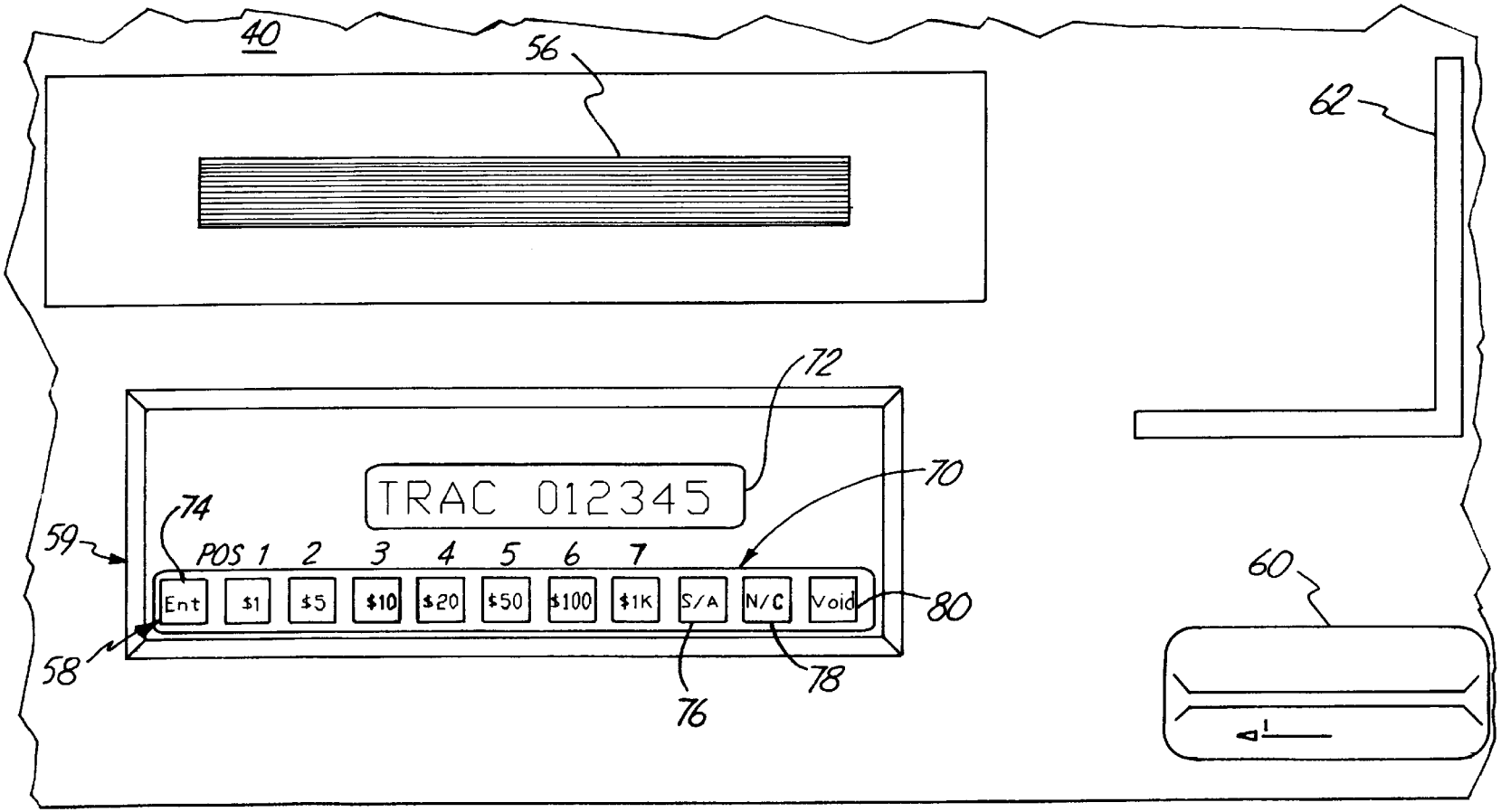
FIG. 2C is a greatly enlarged view of a portion of the table top shown in FIG. 2A.

FIG. 2C is an enlarged view of a portion of table top 40 shown in FIG. 2. FIG. 2C shows drop paddle 56, keypad 58, magnetic card reader 60 and used card holder 62. Keypad 58 is supported by a housing 59 and includes a set 70 of operator actuable key inputs and a display 72. Set of keys 70 includes a plurality of denomination keys. In the embodiment shown in FIG. 2A, the denomination keys range from $1.00 to $1,000.00. Set 70 also includes an enter key 74, security alert key 76, non-cash transaction key 78 and void key 80. It should be noted that the housing 59 which holds keypad 58 and display 72 is low profile to preferably fit entirely behind paddle 56.

Bill drops are recorded by the dealer very quickly and easily. Gaming tables typically only accept bills in certain denominations, or combinations thereof. Those denominations are listed in set of input keys 70. The dealer takes the bills, tallies the denomination, presses the appropriate denomination key or combination of denomination keys, and that amount (or summed amount if successive denomination keys are pressed) is shown on display 72. If the display is correct, the dealer presses enter key 74 and then drops the bills. This denomination value is sent to table control unit 64 where it is stored with other denominations which have been dropped in the lock box.

If, upon entering the denomination value by actuating the appropriate keys, the operator views display 72 and realizes that a mistake has been made in entering the denomination values, the operator simply depresses void key 80 and re-enters the proper value.

If the dealer wishes to alert security for the reasons discussed above, the dealer first presses security alert (S/A) key 76. The dealer then presses a denomination key but, instead of representing a denomination, the key represents the position of the suspicious player at the table. For example, the position associated with each key is written above the key. Therefore, if the player presses S/A key 76 then the $10.00 denomination key, display 72 will display a position 3 security message. Upon the dealer pressing the enter key 74, this message is sent to security. Security personnel can then take appropriate action, such as to swing a camera to cover position 3 at that table, or send a security person to the table, if necessary.

If a player wishes to make a non-cash transaction, such as bet using a marker, the dealer presses the denomination value for the amount of credit which the player wishes to be extended and then depresses the non-cash (N/C) key 78. The dealer also takes the players identification card and passes it through magnetic card reader 60. At that point, table control unit 64 sends a message to host controller 30. Host controller 30 accesses the appropriate data base to determine whether the player identified by the identification card passed through the magnetic card reader 60 has sufficient credit such that the dealer can honor the credit requested by the player. If the credit value is sufficient, an appropriate message is displayed on display 72 so that the dealer may proceed. If not, an appropriate message is also displayed on display 72 so that the dealer can indicate to the player that the credit requested is in excess of the available credit allowed that player.

In one preferred embodiment, the dealer starts a non-cash transaction by swiping the player's card through card reader 60. The player's name and available credit are then made available to the dealer at display 72 and to the floor manager.

e. player tracking

If a player having an identification card wishes to be rated, the player can provide the identification card either to the dealer. The dealer then passes the player's card through magnetic card reader 60 at table 20. Once the player has been identified by swiping the player's card, the floor manager can then observe the player for a period of time and enter into the system either at the pit control unit the player's approximate average bet. When the player is finished playing, the dealer again passes the player's identification card through the appropriate card reader.

The time interval between the player's card being passed is used by host controller 30 in determining the approximate amount which the player has bet during that time interval. In other words, either the dealer or the floor manager has already entered the player's approximate average bet. By knowing the time interval that the player was playing, and by estimating the average number of decisions or hands played per unit of time, the host controller 30 can determine the approximate amount bet by the player. Since host controller 30 is also programmed with information indicative of the odds associated with the particular game being played by the player, host controller 30 can determine and store information about the theoretical win which the casino has made based on the player's bets. Also, since the player's table position is associated with each buy-in, the player's total buy-ins are tabulated.

This information is used in rating the player, and in returning a certain amount of complimentary dollars or points to the player which can be used at the casino. Therefore, the present system provides a quick and efficient way of rating players which has been previously unavailable.

f. detailed configuration of the table control unit

Figure 3:
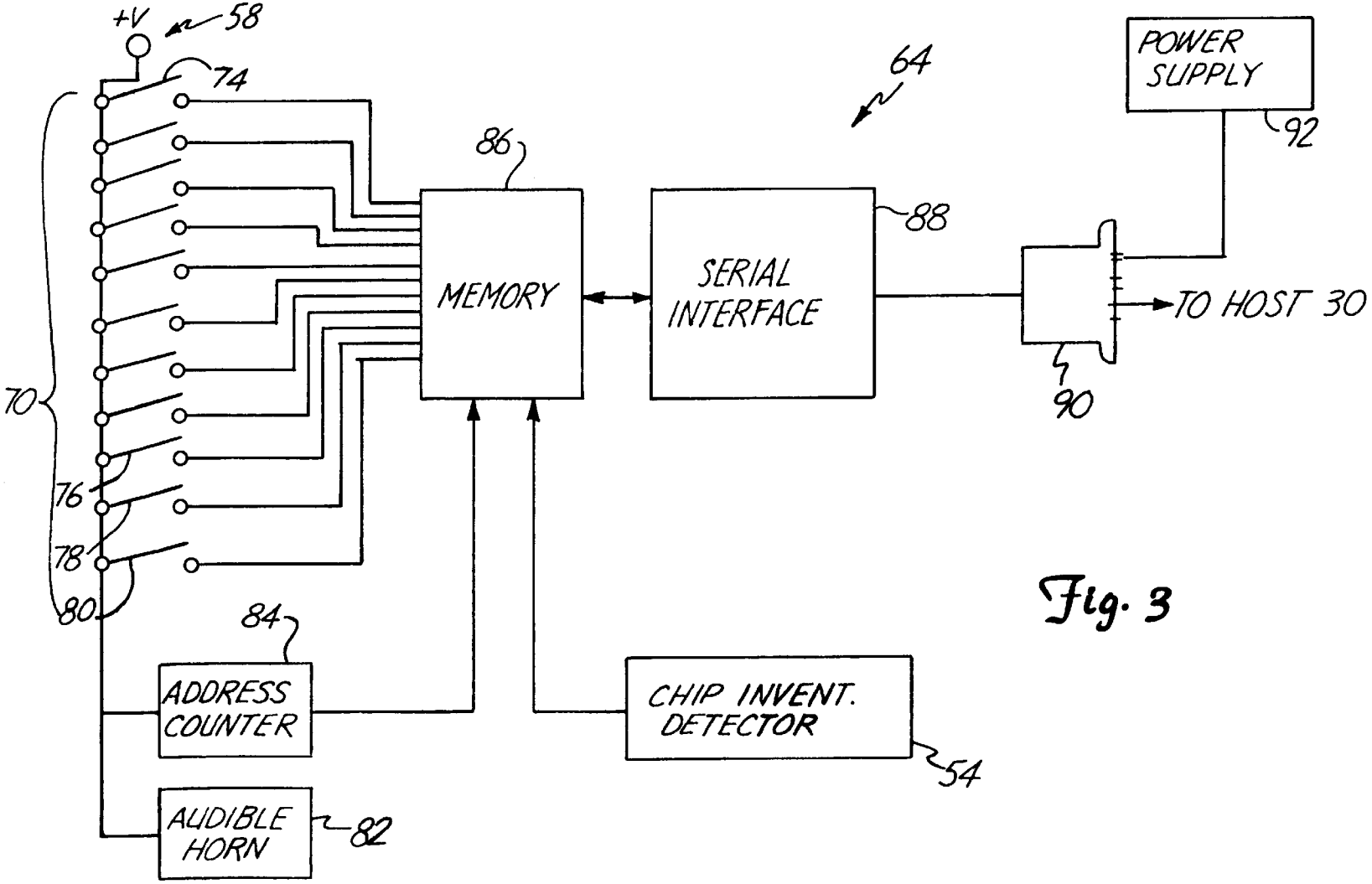
FIG. 3 is a block diagram of one embodiment of a portion of a control system according to the present invention.

FIG. 3 is a block diagram of one embodiment of table control unit 64. FIG. 3 shows keypad 58, along with audible horn 82, address counter 84, chip inventory detector 54, memory 86, serial interface 88, connector 90 and power supply 92. The keys of keypad 58 are simply configured as switches which connect a high voltage potential to the data input lines of memory 86. In one preferred embodiment, memory 86 is a 1024 byte buffer memory integrated circuit device.

Address counter 84 is also coupled to keypad 58. Address counter 84 provides logical signals on the address inputs to memory device 86. Each time the enter key is depressed, the address counter 84 increments to store data at a next available address in buffer memory 86. In one preferred embodiment, horn 82 is simply a beeper which beeps every time one of the keys is depressed on keypad 58.

Periodically, chip inventory detector 54 detects the inventory of chips in chip tray 52. This causes address counter 84 to increment the address output. The chip inventory detected is then stored at the appropriate location in memory device 86. Information is stored in memory 86 until table control unit 64 is polled by the host control unit 30. At that time, all of the data in memory 86 is transmitted via serial interface 88 and connector 90 to the host control unit 30. Power supply 92 provides appropriate power for table control unit 64 and the associated circuitry.

Figure 4:
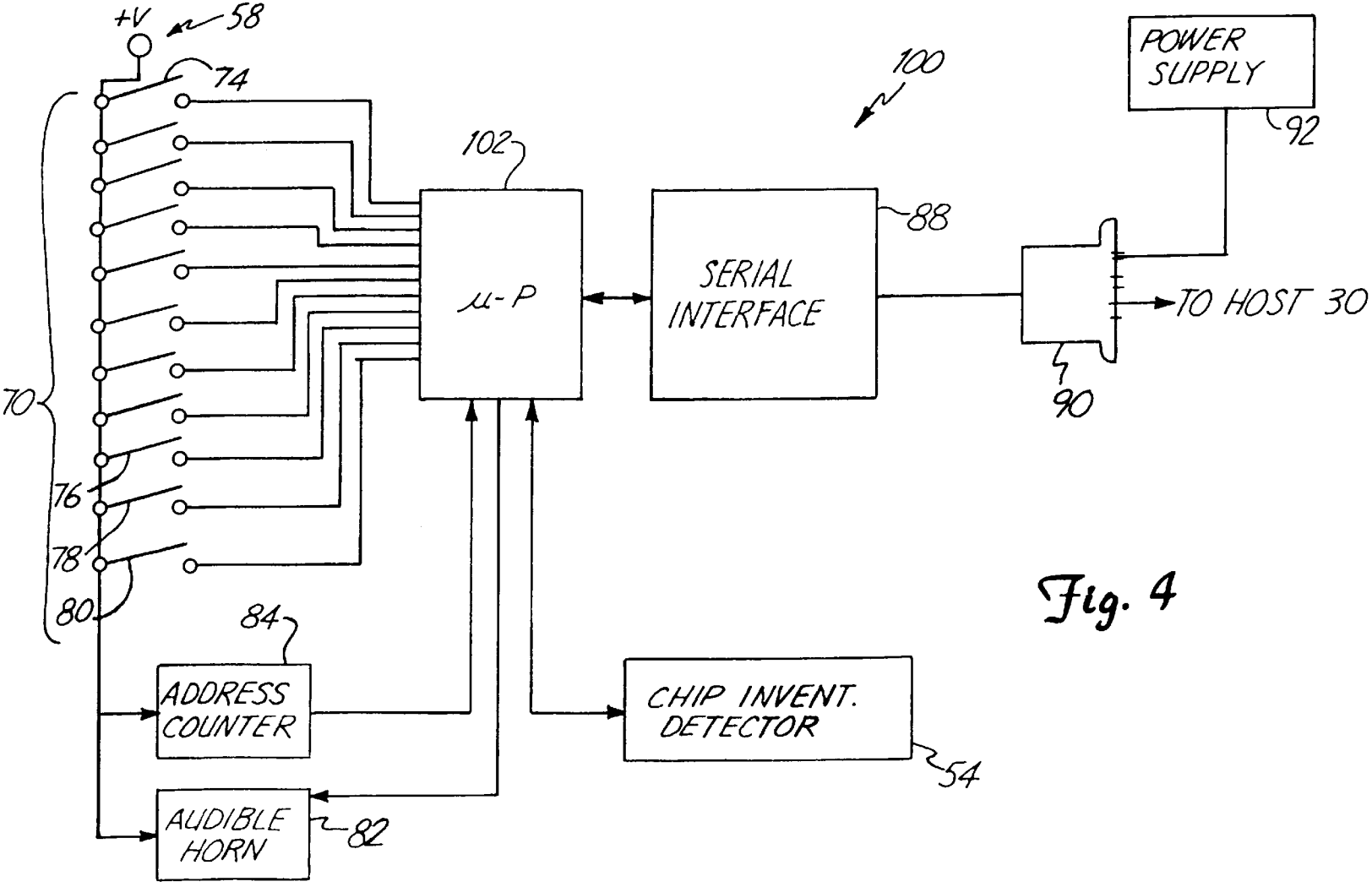
FIG. 4 is a block diagram of a second embodiment of a portion of a control system according to the present invention.

FIG. 4 shows a second embodiment of a table control unit 100. It is similar to table control unit 64 in many ways, and similar items are similarly numbered. However, control unit 100 includes a microprocessor 102. Microprocessor 102 is coupled to keypad 58, audible horn 82, chip inventory detector 54 and serial interface 88. Microprocessor 102 preferably also has associated buffer memory (not separately shown) of sufficient size to hold a desired amount of data until it can be transmitted to the associated pit control unit.

g. chip inventory detector 54

Figure 5:
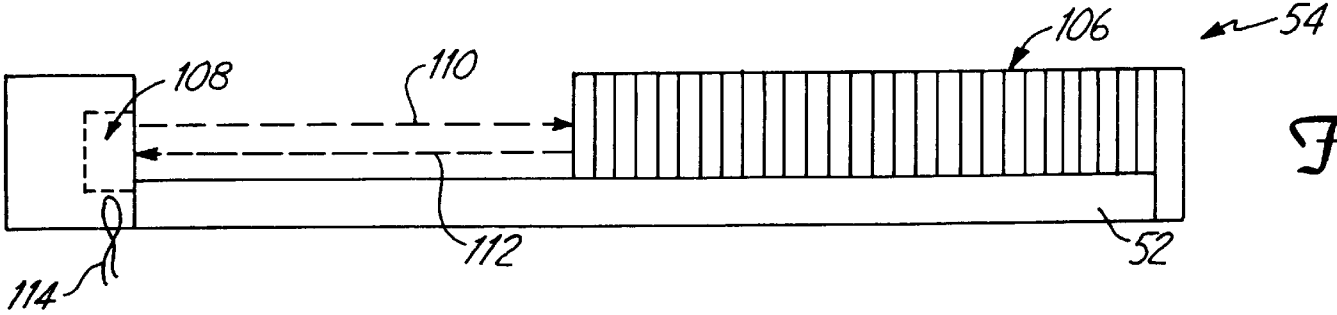
FIG. 5 is a diagram of a chip inventory detector according to the present invention.
Figure 6:
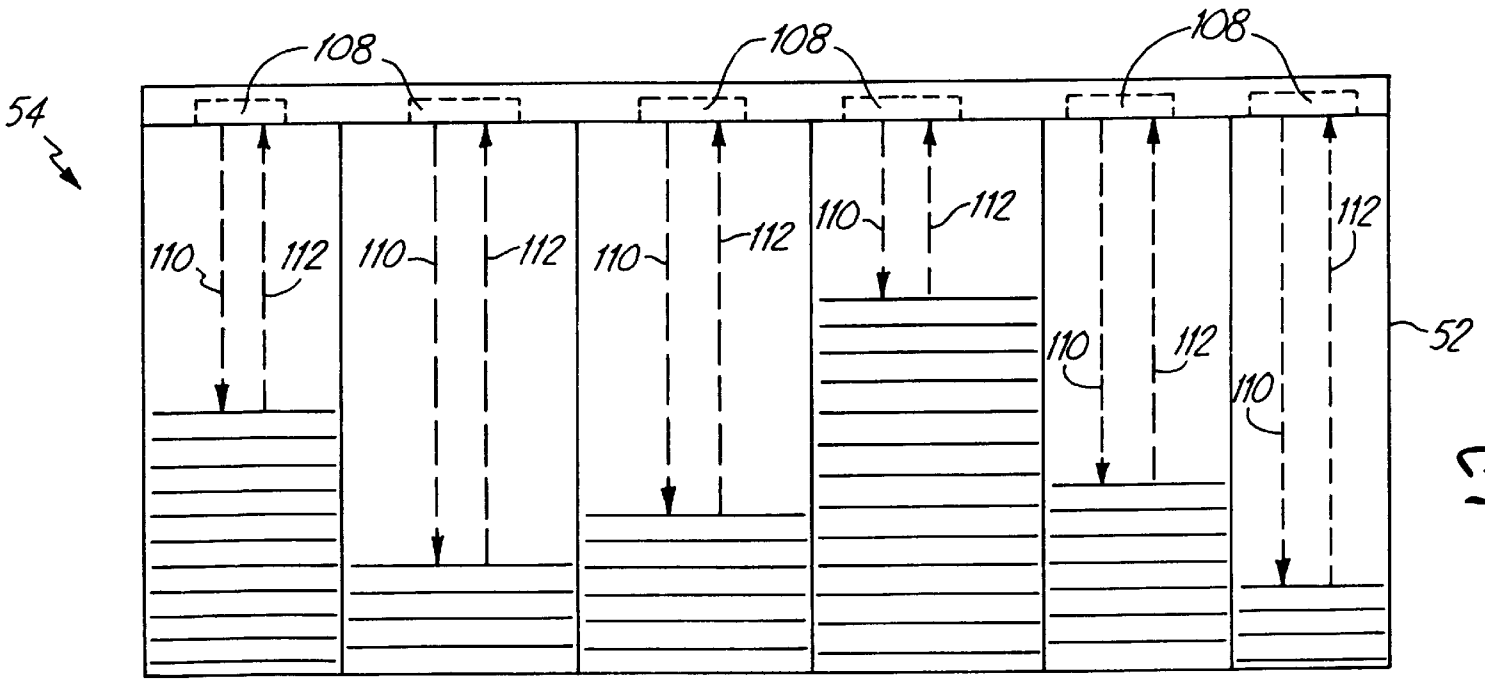
FIG. 6 is a top view of a chip tray with the chip inventory detector shown in FIG. 5.

FIGS. 5 and 6 are simplified illustrations of chip inventory detector 54. FIGS. 5 and 6 show chip tray 52 with a plurality of chips 106 sitting therein. Chip inventory detector 54 has a plurality of ultrasonic transducers 108 mounted in an end thereof. In the preferred embodiment, one ultrasonic transducer 108 is mounted in each cylinder or bin of chip tray 52. The ultrasonic transducer transmits an ultrasound pulse in the direction indicated by arrow 110. The ultrasound pulse is reflected off of the last chip in chip tray 106 back towards transducer 108 in the direction indicated by arrow 112. Based on the time required for the reflected pulse to reach transducer 108, the number of chips 106 in that cylinder or bin of tray 52 can be determined. The transducer 108 is controlled, in one embodiment, by a plurality of conductors 114 which are coupled to the remainder of the table control unit. One ultrasonic transducer suitable to operate in the present invention is commercially available and made by Polaroid. Of course, other transducers could also be used. For instance, optical detectors are also suitable.

3. Count Room Operations

All lock boxes 66 from all three shifts of the previous day are typically present in the locked count room. The count team enters the room. The lock box 66 from each table for each shift is opened in turn. As the count is called out by team member number one, the unique identification for each lock box 66 is entered at the count room control unit 32 along with the total dollars of each denomination counted. Count team member number two then repeats the count while team member number one verifies the numbers present on count room control unit 32 which were previously entered by count member number two. When there is agreement about the numbers between member number one and member number two, they are confirmed on the control unit 32 and a count ticket is generated showing the values of the count, the opening inventory for the shift and tables counted, the inventory fills and credits performed during the shift at the table, the closing inventory, the total drop counted, and the tables win/loss for the shift. Count member number three repeats the calculation of win/loss based on the paperwork in the lock box 66 and calls out the win/loss. This is verified to the printed ticket and if they match, the process is complete for this box 66.

After the count, a report is generated for management which compares the dollars recorded at the tables 20 in the pits 12, 14, 16 and 18, and the dollars recorded in the count room along with any variance between the reported amounts from each location. Thus, the present system provides a check and balance among the various groups handling cash in the casino. This was substantially unavailable in prior systems.

4. Cashier/Vault Inventory Reconciliation

After each shift change in the pit, the vault operator requests a shift reconciliation on the cashier/vault control unit. This form prints in the vault showing the previous shifts beginning inventory, each fill or credit processed for the pit(s) during that shift, and a calculation of the ending inventory for the vault. This inventory is compared to the physical count and signed by the vault personnel, as confirmation to the accounting and management of the casino of the dollar value of chips in and transferred from the vault during the shift.

Therefore, it can be seen that the present invention provides a system which makes the management of table games in a casino far more efficient and far more accurate. The present invention provides data which can be used to implement real time tracking such that the performance of a given gaming table, group of tables or pit can be tracked, the performance of a given dealer can be tracked, and the activities of a given player can be tracked, all in real time. The present system also greatly enhances security operations. The amount of money in each lock box is accurately recorded, on a real time basis. This can be double checked in the count room. Further, coin fills and removals (credits) are verified and accurately tracked using the present system.

Also, the present system provides a two-way electronic communication link between the security personnel in the casino, and each and every dealer on the floor of the casino, as well as the floor managers and pit managers. This provides significantly streamlined operations.

Although the present invention has been described with reference to preferred embodiments, workers skilled in the art will recognize that changes may be made in form and detail without departing from the spirit and scope of the invention.

What is claimed is:

1. An apparatus for managing a gaming table operation comprising:

at least one table data entry device including:

a chip inventory detector for detecting chip inventory in a chip tray;

a denomination input device for recording cash amounts deposited into a lock box coupled to a gaming table;

a computer having a data storage device, the table data entry device being coupled to the computer; and a controller coupled to the chip inventory detector for operating the chip inventory detector; and an input device coupled to the controller for operating the chip inventory detector to record chip inventory associated with a chip fill credit.

2. The apparatus of claim 1 wherein table data is stored by the computer according to a shift for which the data was collected and including:

an input device coupled to the controller for operating the chip inventory detector to record chip inventory at a shift change.

3. The apparatus of claim 2 wherein the input device for operating the chip inventory detector to record chip inventory at a shift chance is a magnetic card reader.

4. The apparatus of claim 1 wherein the computer includes a remote computer spaced from the table data entry device and a plurality of table data entry devices are coupled to the remote computer.

5. The apparatus of claim 1 wherein the input device for recording chip inventory for chin fills or credits is a magnetic card reader.

6. The apparatus of claim 1 wherein the apparatus includes a means for automatically uploading data from the table data entry device at periodic intervals.

7. The apparatus of claim 1 wherein the apparatus includes:

the controller includes a threshold chip detector for determining when chip inventory is above or below the chip inventory threshold.

8. The apparatus of claim 4 wherein the table data entry device includes a security alert input for transmitting a security alert to a remote computer.

9. The apparatus of claim 1 wherein the table data entry device includes:

an input for inputting a patron's table seat position for cash deposited into a lock box.

10. The apparatus of claim 4 wherein the remote computer includes a database including patron credit information and the table data entry device includes means for receiving and displaying credit authorization.

11. The apparatus of claim 2 including:

a processor programmed for calculating table operations for a shift based upon opening and closing chip inventories, shift chip fills and credits, and recorded shift cash amounts deposited into a lock box.

12. In combination:

at least one gaming table data entry device including a denomination input device for recording cash amounts deposited into a lock box coupled to a gaming table;

a computer having a data storage device; and a count room terminal coupled to the computer and including a data input device for inputting cash counted in a lock box;

the computer being programmed to compare cash counted in the lock box and recorded cash deposited in the lock box for reconciling cash counted with recorded cash deposits into a lock box.

13. The combination of claim 12 including:

a chip inventory detector for detecting chip in a chip tray;

controller coupled to the chip inventory detector;

input device coupled to controller for operating the chip inventory detector to record chip inventory at a shift change and inventory with a chip fill or credit; and the computer being programmed to calculate table wins/losses for a shift based upon opening and closing chip inventory, chip fills and credits and cash inputted to the lock box.

14. A method for monitoring operations at a gaming table comprising the steps of;

providing a table data entry device for a gaming table, the table data entry device configured for entry of cash transaction amounts deposited into a lock box;

providing a chip inventor detector, the chip inventory detector being coupled to a controller;

providing an input device coupled to the controller for operating the chip inventory detector to record a shaft opening inventory;

providing an input to the input device to operate the chip inventory detector to record a shift open inventory;

inputting cash transaction amounts via the table data entry device contemporaneously with depositing money in a lock box;

storing the cash transaction amounts according to the shift for which the data was collected; and providing an input to the input device to operate the chip inventory detector to record a shift close inventory.

15. The method of claim 14 comprising the step of:

counting the cash in a lock box and reconciling the counted amount with the amount recorded by the table data entry device.

16. The method of claim 14 comprising the step of:

providing an input to the input device to operate the chip inventory detector to record chip fills and credit inventory.

17. The method of claim 16 and comprising the step of:

tabulating win/loss data for a table for a shift based upon shift opening and closing inventory, fills and credits and cash deposited to the lock box.

18. The method of claim 14 and comprising the steps of:

proving a threshold chip detector;

detecting when chip inventory is above or below a chip threshold amount by operation of chip inventory detector; and transmitting a chip fill or credit request to a chip vault terminal to request a chip fill or credit for a particular table.

19. The method of claim 14 wherein the input device for operating chip inventory detector is a magnetic card reader and comprising the step of:

swiping a card including employee identification information through the card reader to initiate a chip fill or credit.

20. The apparatus of claim 1 further including:

an input device coupled to the computer for recording the identity of gaming personnel operating table entry devices.

21. The apparatus of claim 4 wherein the remote computer includes a pit control unit wherein chip fill or credit information is entered into the pit control unit for recording chip fills and credits.

22. The apparatus of claim 4 wherein the remote computer is programmed for entry of chip fill and credit amounts and the computer is programmed to compare the chip fill and credit amounts entered into the remote computer with chip inventory detected by the chip inventory detector device after a chip fill or credit.

* * * * *